US009266708B2

(12) United States Patent
Rasmussen et al.

(10) Patent No.: US 9,266,708 B2
(45) Date of Patent: Feb. 23, 2016

(54) METHOD OF DISPENSING CARBONATED BEVERAGE, A BEVERAGE DISPENSING SYSTEM AND A COLLAPSIBLE CONTAINER

(71) Applicant: CARLSBERG BREWERIES A/S, Copenhagen V (DK)
(72) Inventors: Jan Norager Rasmussen, Olstykke (DK); Steen Vesborg, Gentofte (DK)
(73) Assignee: Carlsberg Breweries A/S, Copenhagen V (DK)

( * ) Notice: Subject to any disclaimer, the term of this patent is extended or adjusted under 35 U.S.C. 154(b) by 0 days.
(21) Appl. No.: 14/376,545
(22) PCT Filed: Jan. 28, 2013
(86) PCT No.: PCT/EP2013/051576
§ 371 (c)(1),
(2) Date: Aug. 4, 2014
(87) PCT Pub. No.: WO2013/113657
PCT Pub. Date: Aug. 8, 2013
(65) Prior Publication Data
US 2015/0028052 A1 Jan. 29, 2015
(30) Foreign Application Priority Data
Feb. 3, 2012 (EP) ..... 12153871
Feb. 7, 2012 (EP) ..... 12154154
(51) Int. Cl.
*B67D 1/04* (2006.01)
*B67D 1/12* (2006.01)
*B67D 1/07* (2006.01)
*B67D 1/00* (2006.01)
*B67D 1/08* (2006.01)
*B67D 1/06* (2006.01)
(52) U.S. Cl.
CPC ..... *B67D 1/0437* (2013.01); *B67D 1/0001* (2013.01); *B67D 1/0081* (2013.01); (Continued)
(58) Field of Classification Search
CPC .. B67D 1/0081; B67D 1/0085; B67D 1/0425; B67D 1/0462; B67D 1/06; B67D 1/07; B67D 1/12; B67D 1/0807; B67D 1/0835; B67D 1/125; B67D 1/1252; B67D 1/0082; B67D 2001/0828; B67D 2210/00034; B67D 1/0437; B67D 1/0001; B67D 1/1247; B67D 1/1272
USPC ..... 222/1, 52, 55, 61, 95, 105, 144.5, 222/146.6, 183, 325, 394, 399, 386.5, 129.1
See application file for complete search history.

(56) References Cited

U.S. PATENT DOCUMENTS 5,009,082 A * 4/1991 Abraham, III ..... 62/390
5,240,144 A * 8/1993 Feldman ..... 222/82
(Continued)

FOREIGN PATENT DOCUMENTS

DE 2736281 2/1979
DE 29604703 U1 7/1996
(Continued)

OTHER PUBLICATIONS

International Search Report on corresponding PCT application (PCT/EP2013/051576) from International Searching Authority (EPO) dated Mar. 22, 2013.

*Primary Examiner* — Frederick C Nicolas
(74) *Attorney, Agent, or Firm* — Klein, O'Neill & Singh, LLP

(57) ABSTRACT

A method of dispensing carbonated beverage comprises the step of providing a beverage dispensing system (12) comprises a pressure chamber (24), which chamber accommodates a collapsible beverage container (48) made of a flexible material. The collapsible beverage container includes a beverage space, a head space, a dispensing device (76), a tapping line (18), and an interruption valve (40). The method further comprises the step of maintaining a first elevated pressure within the pressure chamber (24), which acts on the collapsible beverage container (48) for crumpling the collapsible beverage container (48) at a container crumpling pressure and establishing a second elevated pressure, the first elevated pressure being equal to the sum of the second elevated pressure and the container crumpling pressure. The method still further comprises the step of operating the dispensing device (76) from the non-beverage dispensing position to the beverage dispensing position.

15 Claims, 10 Drawing Sheets

(52) U.S. Cl.
CPC ..... *B67D1/0082* (2013.01); *B67D 1/0462* (2013.01); *B67D 1/0807* (2013.01); *B67D 1/1247* (2013.01); *B67D 1/1272* (2013.01); *B67D 1/0085* (2013.01); *B67D 1/0425* (2013.01); *B67D 1/06* (2013.01); *B67D 1/07* (2013.01); *B67D 1/0835* (2013.01); *B67D 1/12* (2013.01); *B67D 1/125* (2013.01); *B67D 1/1252* (2013.01); *B67D 2001/0828* (2013.01); *B67D 2210/00034* (2013.01)

(56) References Cited

U.S. PATENT DOCUMENTS

| | | | | |
|---|---|---|---|---|
| 8,028,857 | B2 * | 10/2011 | Rasmussen | 222/1 |
| 8,109,115 | B2 * | 2/2012 | Pippia et al. | 62/378 |
| 8,479,955 | B2 * | 7/2013 | Vesborg et al. | 222/146.6 |
| 2004/0011828 | A1 * | 1/2004 | Van Der Klaauw et al. | 222/527 |
| 2010/0176147 | A1 * | 7/2010 | Segers | 222/1 |
| 2010/0276452 | A1 * | 11/2010 | Vesborg et al. | 222/144.5 |
| 2013/0081443 | A1 * | 4/2013 | Rasmussen et al. | 73/19.06 |

FOREIGN PATENT DOCUMENTS

| | | |
|---|---|---|
| WO | WO2007/019848 | 2/2007 |
| WO | WO2009/024147 | 2/2009 |
| WO | WO2010/020644 | 2/2010 |
| WO | WO2010/029122 | 3/2010 |
| WO | WO2010/060946 | 6/2010 |
| WO | WO2010/060949 | 6/2010 |
| WO | WO2011/002295 | 1/2011 |
| WO | WO2011/117192 | 9/2011 |

* cited by examiner

METHOD OF DISPENSING CARBONATED BEVERAGE, A BEVERAGE DISPENSING SYSTEM AND A COLLAPSIBLE CONTAINER

CROSS-REFERENCE TO RELATED APPLICATION

This application is a national phase filing, under 35 U.S.C. §371(c), of International Application No. PCT/EP2013/051576, filed on Jan. 28, 2013, the disclosure of which is hereby incorporated by reference in its entirety.

FEDERALLY SPONSORED RESEARCH OR DEVELOPMENT

Not Applicable

The present invention relates to a method of dispensing carbonated beverage, a collapsible beverage container and a beverage dispensing system.

BACKGROUND

Beverage dispensing systems are typically used in beverage dispensing establishments for efficiently dispensing large quantities of beverage. Typically, beverage dispensing systems are used to dispense carbonated alcoholic beverages such as draught beer and cider. However, also non-alcoholic carbonated beverages such as soft drinks may be dispensed using a beverage dispensing system. Beverage dispensing systems are mostly for professional users such as in establishments like bars, restaurants and hotels, however, increasingly also for private users such as in private homes.

Professional beverage dispensing systems typically dispense beverage provided in large beverage containers. Such beverage containers may hold 20-50 liters of beverage for a professional beverage dispensing system for allowing typically 50-100 beverage dispensing operations before needing to exchange the beverage container. Conventional beverage containers are made of solid materials such as steel and refilled a number of times. Recently, beverage containers have been made collapsible and for single use only due to hygiene concerns when refilling solid beverage containers. An example of a beverage dispensing system using collapsible beverage containers is the DraughtMaster™ system provided by the applicant company. Such beverage dispensing systems using collapsible beverage containers typically have the beverage container installed in a pressure chamber. Some examples of prior art beverage dispensing systems follow below:

In WO 2007/019848, a beverage dispensing system is described. The beverage dispensing system comprises a pressure chamber, which is adapted to accommodate a beverage container of collapsible material.

In WO 2009/024147, a module for a modular beverage distribution system is disclosed. Each system comprises a frame, a pressure chamber and connectors for receiving pressure fluid and for supplying the pressure fluid to the pressure chamber and to the neighbouring module. The system has a separate rinsing line. By using a specially designed discharge valve, alternatively rinsing fluid or beverage may enter the tapping line. Rinsing fluid is provided from a separate pressurized reservoir. The discharge valve includes safety features for avoiding mixing rinsing fluid and beverage.

In WO 2010/029122, a method of cleaning the tapping line of a beverage dispensing system is disclosed in which a cleaning and flushing cartridge for internal use is described.

The cleaning and flushing cartridge is installed in the pressure chamber similar to a beverage container and dispensed similar to a beverage.

WO 2010/060946 and WO 2011/117192 both relate to a method of cleaning the tapping line of a beverage dispensing system in which a cleaning and flushing cartridge for external use is described. The cleaning and flushing cartridge is installed outside the pressure chamber and has a pressure fluid source connected. The rinsing and flushing fluid is dispensed similar to a beverage.

WO 2010/060949 relates to a beverage dispensing system having a first and a second detector for generating a control pressure. The method comprises evaluating the control pressures from the control pressure outputs of detectors for determining the operational mode of the beverage dispensing system.

In WO 2010/020644, a method of installing a collapsible beverage container in a beverage distribution unit is disclosed. The method comprises the steps of positioning the collapsible beverage container in a sloped position, pivoting the collapsible beverage container in a rotational motion around a support surface and sliding the collapsible beverage container on the support surface.

When using long dispensing lines, a significant amount of beverage will remain in the tapping line when the beverage container is empty. In order to avoid that this beverage flows backwards through the tapping line, it is contemplated that a non-return valve may be used in the tapping line. Further, in order to prevent dripping, a spring loaded valve may be used. An example of a beverage dispenser including a plurality of valves is DE 296 04 703 U1, in which an electrical liquor dispensing system is disclosed. The tapping line has a non-return valve and a spring loaded lid. The liquor is propelled from a container through the tapping line by an electrical pump and explicitly not by pressurized gas.

When dispensing beverage from the beverage dispensing system using a collapsible beverage container, a pressure fluid, typically a gas, is allowed to enter the pressure chamber. During the dispensing of beverage from the pressure chamber, the pressure fluid acts on the collapsible beverage container and forces the beverage out of the pressure chamber while simultaneously crumpling the collapsible beverage container. The volume of the crumpled collapsible beverage container is thereby reduced corresponding to the amount of the dispensed beverage. The collapsible beverage container is made of flexible and preferably disposable materials such as thermoplastic materials.

The interior of the collapsible beverage container is divided into a beverage space constituting carbonated beverage and initially occupying the majority of the interior of the beverage container and a head space filled with gas, primarily constituting $CO_2$ gas.

While performing a dispensing operation, the force applied to the beverage container by the pressure in the pressure chamber causes the beverage to flow out of the beverage container and into a tapping line. The tapping line leads to a dispensing device which may be located at a distant location such as one floor above the pressure chamber. The dispensing device typically has a tapping valve and a tapping handle for allowing an operator to control the tapping valve and thereby the beverage dispensing operation. The operator, such as a bartender or barmaid, uses the tapping device to control the rate of beverage dispensing.

A problem often observed when the beverage space of the beverage container is empty or almost empty is that the gas of the head space starts entering the tapping line. Such gas will result in gas bubble formation in the tapping line. The presence of gas bubbles in the tapping line will cause excessive frothing and aeration of the carbonated beverage at the tapping valve of the dispensing device. The carbonated beverage dispensed will thus be very foamy and will have a less than optimal taste and appearance. Typically, this beverage therefore has to be disposed of. This is also an indication for the bar employee to exchange the empty and crumpled collapsible beverage container with a new collapsible beverage container filled with beverage.

However, gas will still remain in the tapping line even after the beverage container has been exchanged. This will result in excessive foaming also for the first one or two servings of carbonated beverage. This beverage must be disposed of as well. Thus, the total loss of beverage may amount to 2-4 servings for each beverage container, i.e 1-2 at the beginning of each container and 1-2 at the end of each container, resulting in a loss of about 10% of the beverage included in a typical 20 liter collapsible beverage container.

In case a modular beverage dispensing system is used, i.e. a system wherein a single tapping line is fed from a multitude of collapsible beverage containers, the problem is even larger since the beverage spaces of the different collapsible beverage containers may be empty at different times, resulting in even more beverage lost.

The object of the present invention is thus to dispense beverage while preventing that any gas from the head space is entering the tapping line.

SUMMARY OF THE INVENTION

The above object together with numerous other objects, which will be evident from the below detailed description, are according to a first aspect of the present invention obtained by a method of dispensing carbonated beverage, the method comprising the steps of:

providing a beverage dispensing system, the beverage dispensing system comprising a pressure chamber, the pressure chamber accommodating a collapsible beverage container made of a flexible material, the collapsible beverage container including a beverage space consisting of carbonated beverage and a head space consisting of gas, a dispensing device including a tapping valve and defining a beverage dispensing position and a non-beverage dispensing position, a tapping line interconnecting the collapsible beverage container within the pressure chamber and the dispensing device, and an interruption valve defining an open position and a closed position, the open position allowing carbonated beverage to flow from the beverage space to the dispensing device when the pressure chamber is pressurized, the closed position preventing carbonated beverage to flow from the beverage space to the dispensing device, maintaining a first elevated pressure within the pressure chamber, the first elevated pressure acting on the collapsible beverage container for crumpling the collapsible beverage container at a container crumpling pressure and establishing a second elevated pressure within the collapsible beverage container, the first elevated pressure being equal to the sum of the second elevated pressure and the container crumpling pressure, the interruption valve assuming the open position when the second elevated pressure exceeds a specific non-zero pressure reference, the interruption valve assuming the closed position when the second elevated pressure falls below the specific non-zero pressure reference, and operating the dispensing device from the non-beverage dispensing position to the beverage dispensing position for causing the carbonated beverage to be dispensed at the dispensing device and the collapsible beverage container to crumple, provided the interruption valve assuming the open position.

The beverage dispensing system may be a non-modular system in which one pressure chamber is connected to one dispensing device via a single tapping line, or a modular system in which a plurality of pressure chambers are selectively connected to one or more dispensing devices via one or more tapping lines. The pressure chamber is typically a pressure proof container connected to a fluid pressure source, typically a high pressure air source. The pressure chamber typically has a pressure lid in order to be able to insert and remove the collapsible beverage container. The collapsible beverage container is typically made of a semi rigid metallic or polymeric material having a thickness such that it is capable of retaining its shape during transport and handling but which may collapse and crumple when subjected to an outer pressure. In most cases a blow molded plastic container will be used. The beverage container may be initially sealed during transport and handling. In a new collapsible beverage container, i.e. a non crumpled container, the beverage space typically occupies about 90% to 95% of the total volume of the beverage container and the head space is occupying the remaining 5%-10%.

The tapping line leads from the collapsible beverage container within the pressure chamber to the dispensing device outside the pressure chamber. The dispensing device typically comprise a tapping valve and an tapping handle for the user to be able to selectively dispense or not dispense beverage by switching between the beverage dispensing position in which the tapping valve is open and the non-beverage dispensing position in which the tapping valve is closed.

The first elevated pressure to be maintained in the pressure chamber is established after the collapsible beverage container has been installed in the pressure chamber. The first elevated pressure is typically held substantially constant until the collapsible beverage container is to be exchanged at which time the pressure is let out. The first elevated pressure acts uniformly on the wall of the collapsible beverage container in order to establish the second elevated pressure inside the collapsible beverage container. The second elevated pressure is thus the pressure within the beverage. The first elevated pressure is thus transmitted via the wall of the collapsible beverage container to establish the second elevated pressure. In the present context the applicant has surprisingly found out that the second elevated pressure will be smaller than the first elevated pressure and that the difference between the first elevated pressure and the second elevated pressure is constituted by the pressure required to crumple the collapsible beverage container, i.e. the crumpling pressure, for overcoming the internal resistance against a change of the shape of the wall. Further, it has surprisingly found out that the crumpling pressure is dependent on the level of crumpling of the collapsible beverage container, i.e. a new (full) non-crumpled collapsible beverage container will have a much lower resistance against crumpling than an already crumpled beverage container. Thus, the crumpling pressure increases during beverage dispensing as the volume of the beverage space and thereby the total volume of the collapsible beverage container is reduced. The increase in crumpling pressure is non-linear for most materials and most collapsible beverage containers will exhibit an exponential increase in the required crumpling pressure when the beverage space of the beverage container is almost empty. This effect may be explained by the fact that the first few beverage dispensing operations of a new collapsible beverage container will result in an elastic deformation of the wall of the collapsible beverage container. Such elastic deformation is linear in nature. When the beverage space of the collapsible beverage container is almost empty and the collapsible beverage container is significantly crumpled, the deformation of the wall of the collapsible beverage container will exhibit a plastic deformation, which is non-linear and requires a significantly higher crumpling pressure. Thus, the second elevated pressure will be reduced. In the present context it is understood that the crumpling characteristic of a typical collapsible beverage container will be at least somewhat stochastic, i.e. two seemingly identical collapsible beverage containers may crumple slightly differently depending on the internal wall structure of each collapsible beverage container.

The above fact may be utilized by employing an interruption valve. The interruption valve is preferably situated in the tapping line adjacent the beverage container. As long as the second elevated pressure is higher than the specific non-zero pressure reference, the interruption valve will be open and allow beverage to pass when the dispensing device assumes the beverage dispensing position. Later, when the collapsible beverage container is almost empty and thus seriously crumpled, the crumpling pressure will have increased, and, provided that the first elevated pressure is held substantially constant, the second elevated pressure will be much smaller. When the second elevated pressure falls below the specific non-zero pressure reference, the interruption valve will be closed and beverage will not be allowed to pass even when the dispensing device assumes the beverage dispensing position. This will allow a very well defined end of the beverage dispensing operations when the collapsible beverage container is empty or nearly empty.

The non-zero pressure reference is chosen such that the beverage dispensing is interrupted well before the beverage space is empty such that there is no risk that gas from the head space will enter the tapping line. The specific non-zero pressure reference may thus not be zero, since this would mean that the container crumpling pressure is equal to the first pressure, which first pressure is typically sufficient to completely flatten the collapsible beverage container. In case the first elevated pressure is not significantly higher than the crumpling pressure such that the second elevated pressure is allowed to approach zero, the beverage dispensing will be very slow due to the lack of driving pressure and such situations should also be avoided. Yet further, in case the specific non-zero pressure reference is higher than the first pressure, the interruption valve will always be closed and beverage dispensing never allowed.

By choosing a suitable specific non-zero pressure reference, the interruption valve may be closed when the second elevated pressure is still high enough for dispensing and the beverage space still includes a small amount of beverage. In this way, no gas will be introduced into the tapping line. When a new collapsible beverage container is installed, the tapping line will be free from gas and the first servings of carbonated beverage will not suffer from any excessive foaming. The only lost beverage will be the small amount remaining in the crumpled beverage container, however, this amount will be much smaller than the amount of carbonated beverage lost due to excessive foaming. Calculations made by the applicant using a typical 20 liter beverage container have shown that the average loss amounts to a few per mille only, compared to several percent using the prior art beverage dispensing systems. Taking into account the total amount of carbonated beverage dispensed worldwide, a vast amount of carbonated beverage can be saved.

According to a further embodiment of the first aspect, the interruption valve is located in the collapsible beverage container, the tapping line or the dispensing device. In one preferred embodiment, the interruption valve is located in the collapsible beverage container. In this way there is no need for any modifications of the permanent parts of the beverage dispensing system. In the case that the interruption valve is located in the beverage container, it is contemplated that it may be used for sealing the beverage container during transport and handling, thereby omitting the need for a separate seal. It is further contemplated that the interruption valve may be provided as a re-usable accessory which is mounted on the collapsible beverage container. In another preferred embodiment, the interruption valve is preferably fixedly mounted in the tapping line adjacent the collapsible beverage container. In this way, ordinary collapsible beverage containers may be used. The pressure in the tapping line may be considered to be equal to the pressure within the collapsible beverage container, at least at a location adjacent the collapsible beverage container. However, in case the tapping line leads to another floor of a building, it is contemplated that the pressure will fall. In yet another preferred embodiment, the interruption valve is located in the dispensing device. In this way, a visual indication may be given that the beverage container is empty. In this embodiment, a non-return valve may be used adjacent the beverage container to avoid a return flow of beverage. Further, the pressure may be slightly lower at the interruption valve than inside the collapsible beverage container depending on the height difference between the collapsible beverage container and the dispensing device.

According to a further embodiment of the first aspect, the interruption valve employs a loaded spring or a sealed pressurized gas volume in order to establish the specific non-zero pressure reference. When the second elevated pressure falls below the specific non-zero pressure reference, the interruption valve changes from the open position to the closed position. The specific non-zero pressure reference may be established by a loaded spring having a suitable spring constant and pre-load such that the valve remains open when the second elevated pressure is higher than the specific non-zero pressure reference but closes rapidly when the second elevated pressure falls below the specific non-zero pressure reference. Alternatively, a sealed pressurized gas volume may substitute the spring.

According to a further embodiment of the first aspect, the interruption valve is fluidly connected to the first elevated pressure of the pressure chamber via a pressure regulator for establishing the specific non-zero pressure reference. A particular beneficial solution is to make the specific non-zero pressure reference dependent on the first elevated pressure via a pressure regulator acting as a pressure reduction valve. In this way, the non-zero pressure reference may be made dependent on the first elevated pressure, i.e. the pressure in the pressure chamber. In this way, the first elevated pressure may be increased while still allowing the interruption valve to be closed when the collapsible beverage container has been crumpled to such extent that only a very small amount of beverage remains.

According to a further embodiment of the first aspect, the interruption valve includes a pressure probe for determining the second elevated pressure and an electromagnetic valve for assuming the open and closed positions, respectively, dependent on the second elevated pressure. The pressure probe may be mounted in the tapping line in order to constantly monitor the second elevated pressure. As soon as the second elevated pressure falls below the specific non-zero pressure reference, an electrical signal may be sent to the electromagnetic valve in order for the interruption valve to close. It is contemplated that a control unit may be used to compensate the specific non-zero pressure reference in order to take account of any changes in the first elevated pressure.

According to a further embodiment of the first aspect, the first elevated pressure is in the range of 2-5 bar above atmospheric pressure, preferably 3-4 bar above atmospheric pressure. Such pressures are suitable for achieving a good driving pressure for the beverage which will overcome the crumpling pressure of the collapsible beverage and still allow beverage to be dispensed at a reasonable velocity at a higher location than the location of the beverage container.

According to a further embodiment of the first aspect, the second elevated pressure is in the range of 1-4 bar above atmospheric pressure, preferably 2-3 bar above atmospheric pressure. By considering the crumpling pressure, the second elevated pressure must still allow beverage to be dispensed at a reasonable velocity at a higher location than the location of the beverage container.

According to a further embodiment of the first aspect, the beverage container is positioned in an upside down orientation within the pressure space such that the beverage space is located adjacent the tapping line and the head space is located spaced apart from the tapping line. With upside down position is meant a position in which the outlet of the beverage container is directed downwardly. In this way, the beverage space will be located adjacent the outlet and the head space will be located as far as possible from the outlet and consequently the head space will not reach the outlet until the beverage space is depleted. This will also completely avoid the use of a ascension pipe.

According to a further embodiment of the first aspect, specific non-zero pressure reference is in the range of 0.1-3 bar, preferably 0.5-1 bar, absolute pressure. For most cases such pressure values will be suitable in order to achieve a well defined end of beverage dispensing when the collapsible beverage container is empty or almost empty.

According to a further embodiment of the first aspect, the crumpling pressure being dependent on the level of crumpling of the collapsible beverage container, the crumpling pressure being in the range of 0-1 bar absolute pressure when the beverage container is in an initial non-crumpled state whereas the crumpling pressure is in the range of 2-5 bar when the beverage container is in a crumpled state in which the volume of the beverage container is reduced to 5% of the volume of the beverage container in the initial non-crumpled state. As already stated above, the crumpling pressure is dependent on the level of crumpling, i.e. the more crumpled the beverage container is, the higher pressure is required in order to further crumple the beverage container. Initially, the crumple pressure will be very low, or even zero, since the deformation will be elastic and thereby have a linear relationship with the applied force. However, when only 5% of the original volume remains, the applied force is very high and additional deformation will require even higher force since the deformation may be permanent, i.e. a plastic deformation. The crumpling pressure thus typically is exponentially dependent on the dispensed volume of beverage. Thus, the collapsible beverage container is typically made using such material, volume and wall thickness such that when only 5% of the volume remains, i.e. the crumpling pressure is in the range of 2-5 bar.

According to a further embodiment of the first aspect, when the interruption valve assumes the closed position, the beverage space has a volume of between 1 and 100 ml, preferably between 10 and 50 ml, such as 40 ml. In order to avoid gas entering the tapping line, at least a tiny amount of beverage should remain in the beverage container when the interruption valve assumes the closed position. However, too much beverage remaining in the beverage container would constitute a waste since such beverage will not be dispensed. Thus, in order to have a safety margin in order to take into account the stochastic differences in the crumpling behavior of different collapsible beverage containers, it is preferred to allow about 40 ml of beverage to remain in the beverage container when the interruption valve assumes the closed position According to a further embodiment of the first aspect, the collapsible beverage container is made of the flexible material constituting a thermoplastic material such as PET. PET is a suitable material since it is sufficiently flexible to be crumpled, it is suitable for food and beverage and it may be disposed of in an environmentally friendly way, e.g. by combustion or recycling.

The above object together with numerous other objects, which will be evident from the below detailed description, are according to a second aspect of the present invention obtained by a collapsible beverage container for use together with a beverage dispensing system, the beverage dispensing system comprising a pressure chamber for accommodating the collapsible beverage container, the pressure chamber being capable of maintaining a first elevated pressure within the pressure chamber, the collapsible beverage container being made of a flexible material and including a beverage space consisting of carbonated beverage and a head space consisting of gas, the first elevated pressure acting on the collapsible beverage container for crumpling the collapsible beverage container at a container crumpling pressure and establishing a second elevated pressure within the collapsible beverage container, the first elevated pressure being equal to the sum of the second elevated pressure and the container crumpling pressure, the collapsible beverage container including an interruption valve defining an open position and a closed position, the open position allowing carbonated beverage to flow out from beverage space when the pressure chamber is pressurized, the closed position preventing carbonated beverage to flow out from the beverage space, the interruption valve assuming the open position when the second elevated pressure exceeds a specific non-zero pressure reference, the interruption valve assuming the closed position when the second elevated pressure falls below the specific non-zero pressure reference.

The collapsible beverage container according to the second aspect includes the interruption valve. It is contemplated that the collapsible beverage container according to the second aspect, which includes the interruption valve, may be used together with any of the methods described above in connection with the first aspect.

The above object together with numerous other objects, which will be evident from the below detailed description, are according to a third aspect of the present invention obtained by a beverage dispensing system comprising:

a pressure chamber for accommodating a collapsible beverage container made of a flexible material, the collapsible beverage container including a beverage space consisting of carbonated beverage and a head space consisting of gas, the pressure chamber being capable of maintaining a first elevated pressure within the pressure chamber, the first elevated pressure acting on the collapsible beverage container for crumpling the collapsible beverage container at a container crumpling pressure and establishing a second elevated pressure within the collapsible beverage container, the first elevated pressure being equal to the sum of the second elevated pressure and the container crumpling pressure, a dispensing device including a tapping valve and defining a beverage dispensing position and a non-beverage dispensing position, and a tapping line interconnecting the collapsible beverage container within the pressure chamber and the dispensing device, the tapping line including an interruption valve defining an open position and a closed position, the open position allowing carbonated beverage to flow from the beverage space to the dispensing device when the pressure chamber is pressurized, the closed position preventing carbonated beverage to flow from the beverage space to the dispensing device, the interruption valve assuming the open position when the second elevated pressure exceeds a specific non-zero pressure reference, the interruption valve assuming the closed position when the second elevated pressure falls below the specific non-zero pressure reference.

The beverage dispensing system according to the third aspect includes the interruption valve in the tapping line. It is contemplated that the beverage dispensing system according to the third aspect may be used together with any of the methods described above in connection with the first aspect. The beverage dispensing system according to the third aspect constitutes an alternative solution to the collapsible beverage container according to the second aspect.

The above object together with numerous other objects, which will be evident from the below detailed description, are according to a fourth aspect of the present invention obtained by a beverage dispensing system comprising:

a pressure chamber for accommodating a collapsible beverage container made of a flexible material, the collapsible beverage container including a beverage space consisting of carbonated beverage and a head space consisting of gas, the pressure chamber being capable of maintaining a first elevated pressure within the pressure chamber, the first elevated pressure acting on the collapsible beverage container for crumpling the collapsible beverage container at a container crumpling pressure and establishing a second elevated pressure within the collapsible beverage container, the first elevated pressure being equal to the sum of the second elevated pressure and the container crumpling pressure, a dispensing device including a tapping valve and defining a beverage dispensing position and a non-beverage dispensing position, the dispensing device including an interruption valve defining an open position and a closed position, the open position allowing carbonated beverage to flow from the beverage space to the dispensing device when the pressure chamber is pressurized, the closed position preventing carbonated beverage to flow from the beverage space to the dispensing device, the interruption valve assuming the open position when the second elevated pressure exceeds a specific non-zero pressure reference, the interruption valve assuming the closed position when the second elevated pressure falls below the specific non-zero pressure reference, and a tapping line interconnecting the collapsible beverage container within the pressure chamber and the dispensing device.

The beverage dispensing system according to the fourth aspect includes the interruption valve in the dispensing device. It is contemplated that the beverage dispensing system according to the fourth aspect may be used together with any of the methods described above in connection with the first aspect. The beverage dispensing system according to the fourth aspect constitutes an alternative solution to the collapsible beverage container according to the second aspect and to the beverage dispensing system according to the third aspect.

DETAILED DESCRIPTION

Figure 1:
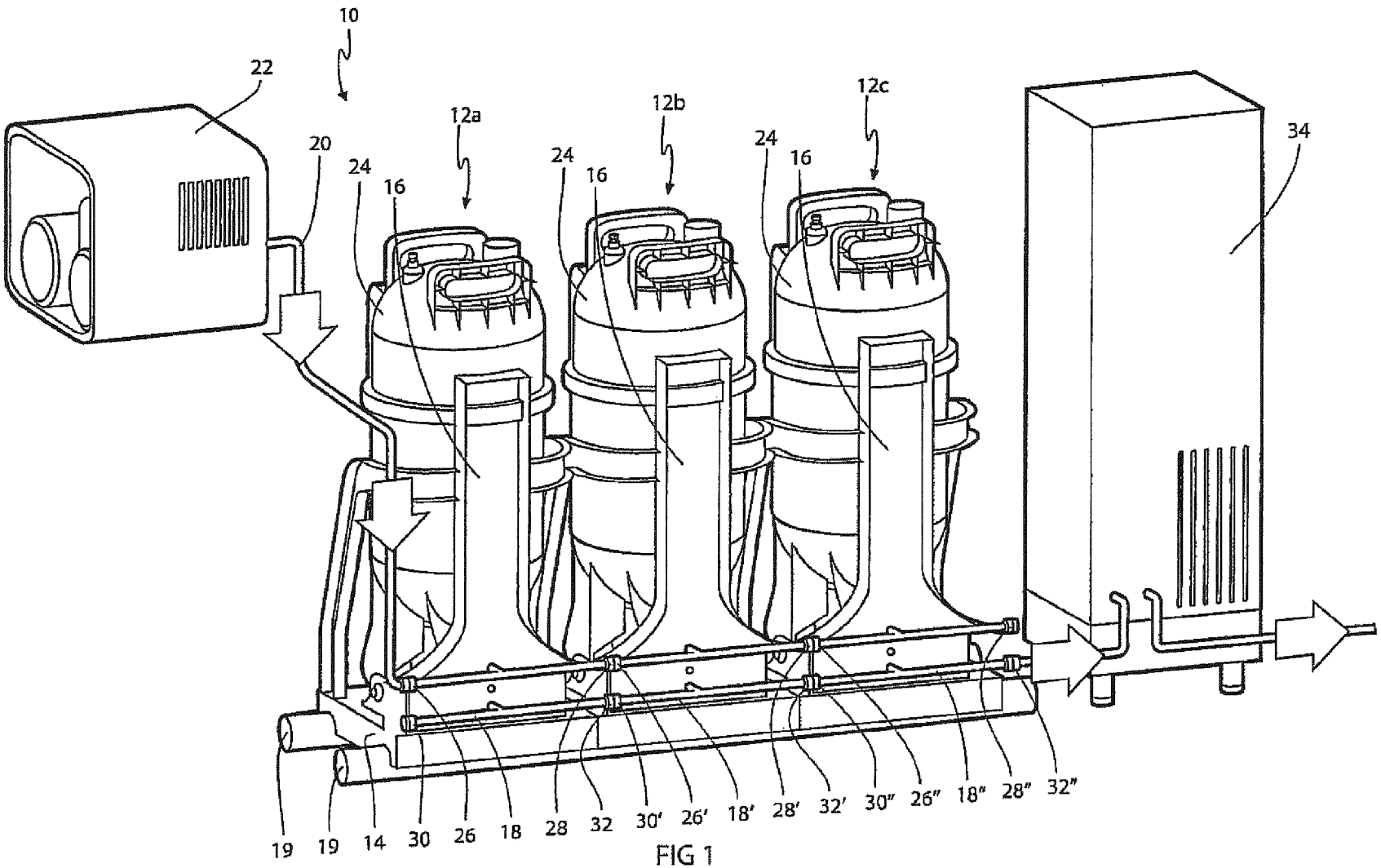
FIG. 1 is a perspective view of a modular beverage dispensing system.
Figure 6A:
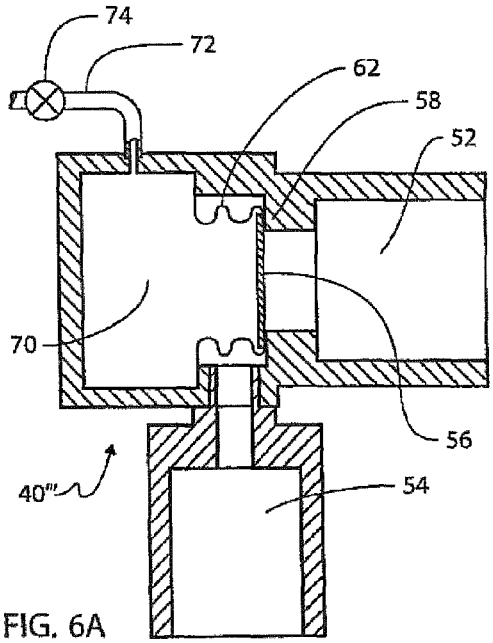
FIGS. 6A and 6B are cross-sectional views of an interruption valve employing a pressure reduction valve and a fluid connection to the pressure chamber, showing the valve in the closed and open positions, respectively.
Figure 6B:
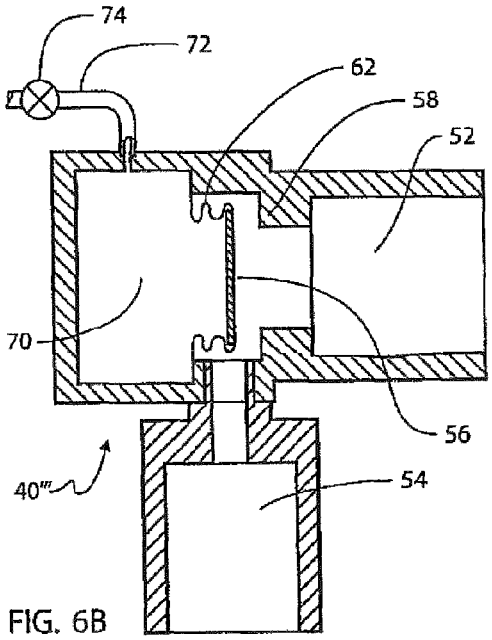
Figure 7:
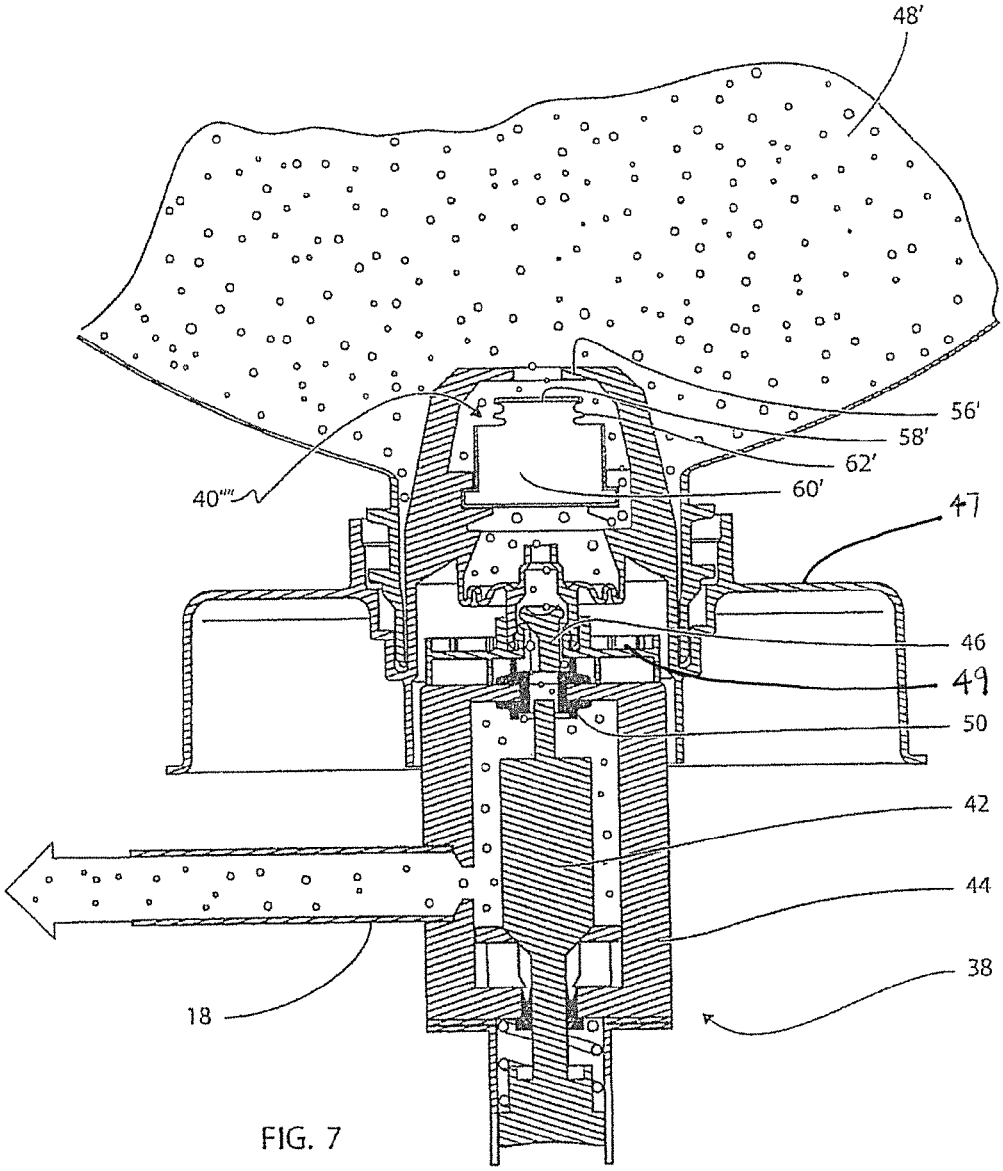
FIG. 7 is a partial cross-sectional view of a collapsible beverage container having an interruption valve.

FIG. 1 shows a perspective view of an embodiment of a modular beverage distribution system 10 for use with a discharge valve as shown in FIGS. 6-7 of the international application WO 2009/024147. The modular beverage distribution system 8' comprises three modules 12*a*, 12*b*, 12*c*, each mounted to a bottom wall 14 and a rear wall 16 constituting a frame. The bottom wall 14 rests on a mounting rack 19. The three modules 28', 30', 32' are mounted in series on the mounting rack 19.

Each of the modules 12*a*, 12*b*, 12*c*, is connected to a tapping line 18 and a gas supply line 20. An optional rinsing line may be available as described in more detail in the above mentioned WO 2009/024147. The tapping line 18 and the gas supply line 20 are mounted near the bottom wall 61" of each module. Each module 12*a*, 12*b*, 12*c* comprises for each of the above mentioned lines 18 20 an inlet constituting a first type connector, an outlet constituting a second type connector and a branch pipe constituting a third type connector. The branch pipe leads to the discharge valve of each module. The outlets of the first module 12*a* are directly connected to the inlets of the second module 12*h* and the outlets of the second module 12*b* are directly connected to the inlets of the third module 12*c*.

Figures 2A, 2B, 2C:
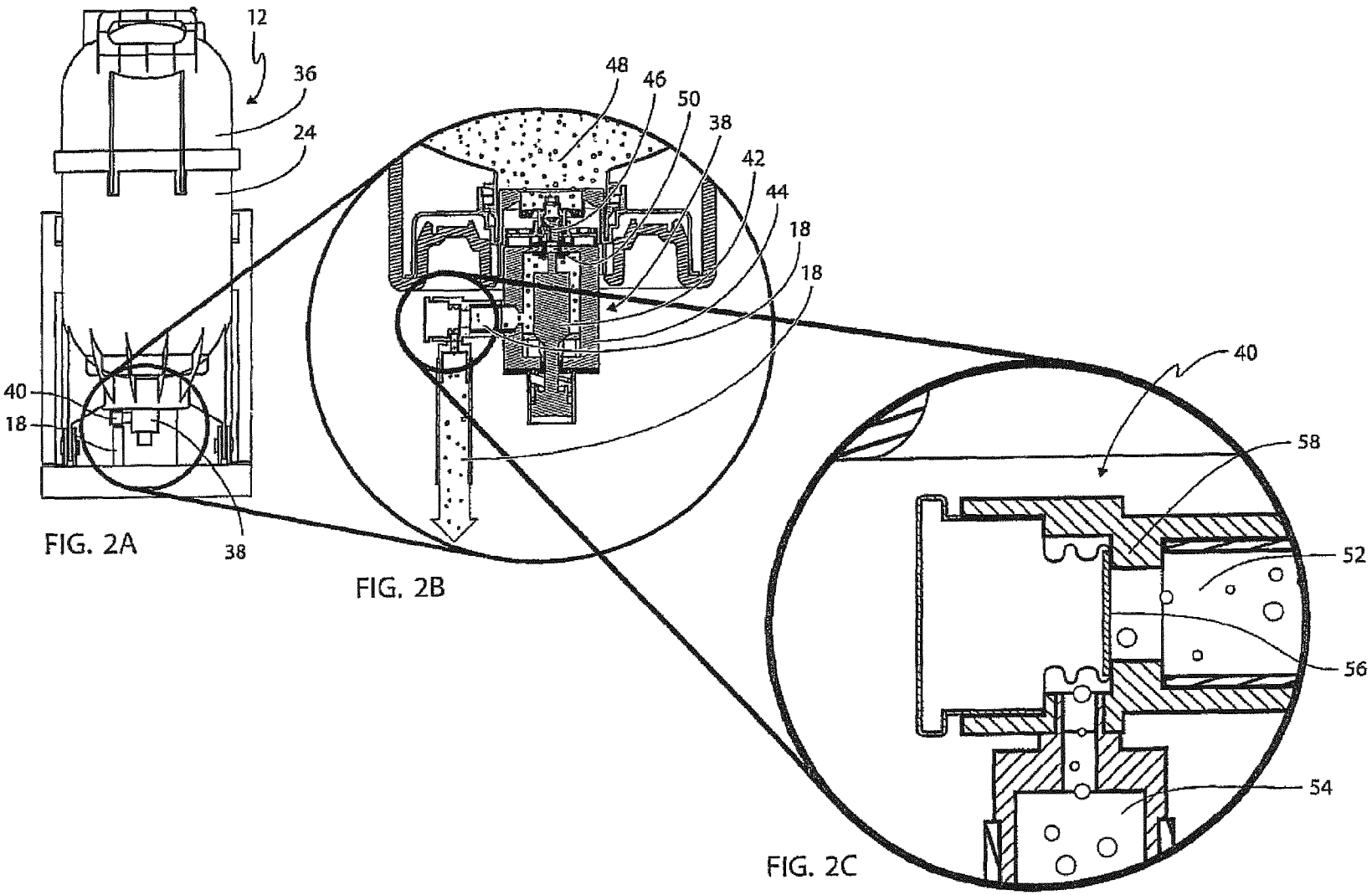
FIG. 2A is an elevation view of a beverage dispensing system having an interruption valve in the tapping line.
FIG. 2B is a detailed cross-sectional view of a portion of FIG. 2A.
FIG. 2C is a detailed cross-sectional view of a portion of FIG. 2B.

The gas supply line 20 is connected directly to a pressure generator 22. The gas supply line 20 is further connected to a pressure chamber 24 of the beverage dispensing module 12*a* via a security valve (not shown). The gas supply line 20 is connected to a pressure inlet 26 of the beverage dispensing module 12*b* via a pressure outlet 28. The fluid path 4T may also provide driving pressure to the discharge valve which is shown in FIGS. 2A-C. The pressure outlet 48' of the last beverage dispensing module 12*c* is left without connection but has a check valve to avoid pressure fluid escaping.

The tapping line inlet 30 of the beverage dispensing module 12*a* is left without connection, however a check valve is provided to prevent beverage from flowing out. The tapping line inlet 30 of the first module 12*a* is connected to the tapping line 18, which is connected to a tapping line inlet 30' of the beverage dispensing module 12*b* via the tapping line outlet 32 of the beverage dispensing module 12*a*. The tapping line outlet 32' of the beverage dispensing module 12*b* is similarly connected to a tapping line inlet 30" of the beverage dispensing module 12*c*. The tapping line outlet 32' of the tapping line 18 of the beverage dispensing module 12*c* is connected via a cooling system 34 to a dispensing device (not shown). The tapping line 18 is connected to a discharge valve of each beverage dispensing module 12*a*, 12*b*, 12*c*, as shown in FIG. 2.

FIG. 2A shows a beverage dispensing system 12 which may be part of a modular beverage dispensing system as shown in connection with FIG. 1, however, it may as well be part of a stand-alone beverage dispensing system. The beverage dispensing system 12 comprises a pressure chamber 24 for accommodating a collapsible beverage container and a pressure lid 36 for allowing access to the pressure chamber 24. The pressure chamber is connected to a tapping line 18. The tapping line 18 comprise a discharge valve 38 and an interruption valve 40.

FIG. 2B shows a close up view of the lower part of the beverage dispensing system 12 including the optional discharge valve 38. The discharge valve 38 comprises a rod or piston 42, which is located inside a coupling housing 44 and which is adapted to act on a closure element 46 of the collapsible beverage container 48 included in the pressure chamber. The closure element 46, which is optional, is in the present embodiment not a part of the coupling housing 44, but part of the collapsible beverage container 48. The discharge valve 38 is operable between three possible positions, which constitute a first position, an opposite second position and an intermediate position. As will be described in greater detail below, the intermediate position constitutes the beverage dispensing position, whereas the first and second positions constitute an optional rinsing position and the closed position, respectively.

The closure element 46 is located in a specific space in the collapsible beverage container 48 between an inlet constriction and an outlet constriction. The inlet constriction and the outlet constriction both provide openings or apertures for allowing beverage to flow from the collapsible beverage container 48. Both the inlet constriction and the outlet constriction constitute valve seats, which the closure element 46 may seal against. The closure element 46 will either establish a seal against the inlet constriction or the outlet constriction, or remain in the intermediate position, shown in which constitutes the beverage dispensing position.

When the rod or piston 42 is in the beverage dispensing position, i.e. in the active or intermediate position, the closure element 46 is located in the intermediate position between the inlet constriction and the outlet constriction as the bottom end of the closure element 46 is resting on a top surface of the coupling housing sealing gasket 50 which, as is evident from FIG. 2B, seals against the bottom surface of the collapsible beverage container 48. In the intermediate position shown in FIG. 2B, the rod or piston 42 is in a lower position, in which the rod or piston is disengaged from contact with the coupling housing sealing gasket 50 allowing free passage through the coupling housing sealing gasket 50. Consequently, the beverage may flow from the beverage container 48 past the closure element 46 and through the coupling housing sealing gasket 50, and the interior of the coupling housing 44, to the tapping line 18.

When the coupling housing 44, and thereby also the rod or piston 42, is separated from the beverage container 48, the beverage, indicated by the signature of "circles" in the figure, will exert a force on the closure element 46 pushing the closure element 46 against the outlet constriction defining the closed position, i.e. the second passive position, thereby sealing off the beverage container 48.

As shown in FIG. 7, the beverage container 48 may be fitted with a base part 47 and a connector component 49, wherein the top part of the discharge valve 38 is received. The closure element 46, the inlet constriction and the outlet constriction are components of the beverage container 48. From the beverage dispensing position shown in FIG. 2B, the rod or piston 42 may be shifted towards the beverage container 48, or alternatively towards the tapping line 18.

The pressure chamber may be pressurized only when beverage dispensing is allowed, i.e. when a beverage container 48 has been installed and the pressure chamber has been swung into vertical orientation. Consequently, the pressure inside the pressure chamber may be used for holding the rod or piston 42 in the beverage dispensing position shown in FIG. 2B. In the following, it is assumed that the closure element 46 is located in the intermediate position, i.e. allowing beverage to pass.

FIG. 2C shows a close-up view of the interruption valve 40. The interruption valve 40, which forms part of the tapping line, comprises an inlet section 52 and an outlet section 54. In-between the inlet section 52 and the outlet section 54, a valve plate 56 is located. When the interruption valve 40 is in the closed position as shown in FIG. 2C, the valve plate bears against a valve seat 58, which forms part of the inlet section 52 in order to completely seal off the inlet section 52.

Figures 2D, 2E:
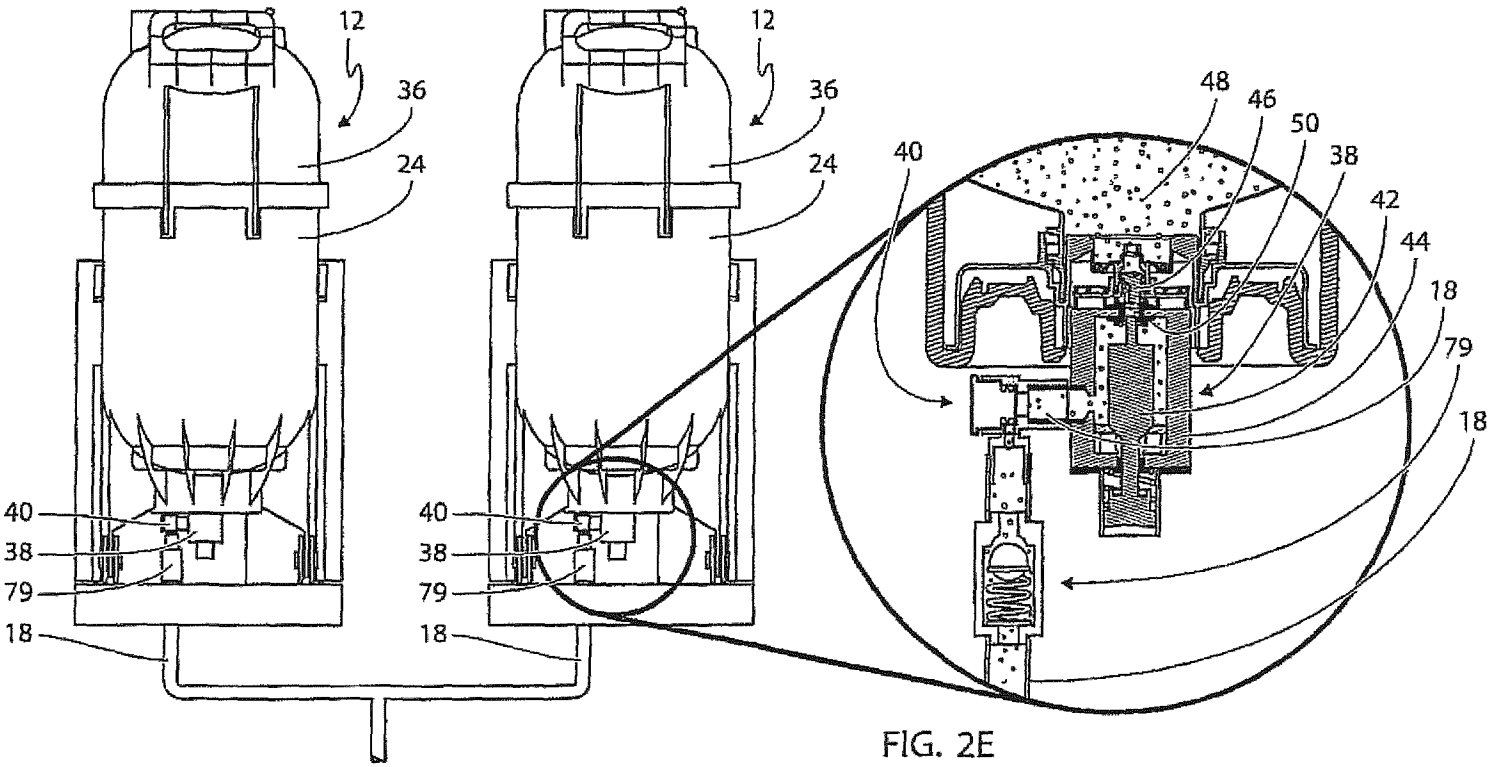
FIG. 2D is an elevation view of another embodiment of a beverage dispensing system having an interruption valve in the tapping line.
FIG. 2E is a detailed cross-sectional view of a portion of FIG. 2D.

FIG. 2D shows two beverage dispensing systems 12 which are interconnected by a common tapping line 18. Each of the beverage dispensing systems 12 includes an interruption valve 40 and a non-return valve 79 connected downstream in relation to the interruption valve 40. The purpose of the non-return valve 79 is to avoid beverage flowing back towards the interruption valve 40 when the beverage dispensing is interrupted.

FIG. 2E shows a close up view of the interruption valve 40 and the non-return valve 79. The non-return valve may constitute a ball valve that is suspended in a weak wire which allows beverage to pass in a direction from the beverage container to the tap and which immediately closes the passage when the beverage starts to flow in the other direction.

Figure 3A:
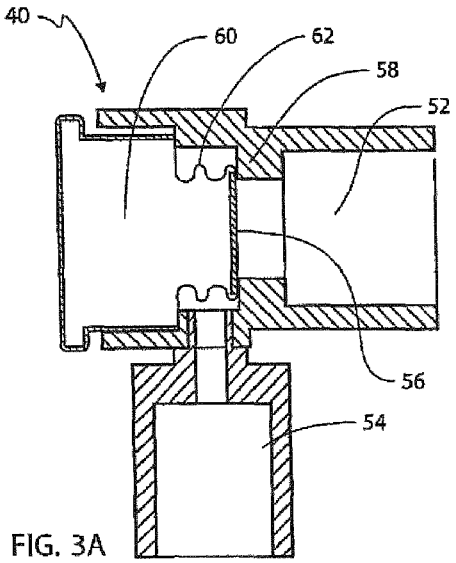
FIGS. 3A and 3B are cross-sectional views of an interruption valve employing a sealed gas volume, in the closed and open positions, respectively.

FIG. 3A shows an interruption valve 40 employing a sealed gas volume 60. The interruption valve 40 is in the closed position. The sealed gas volume 60 has a predetermined pressure and communicates with the valve plate 56 via a sealed bellows 62 such that the valve plate 56 applies a specific non-zero pressure force against the valve seat 58.

Figure 3B:
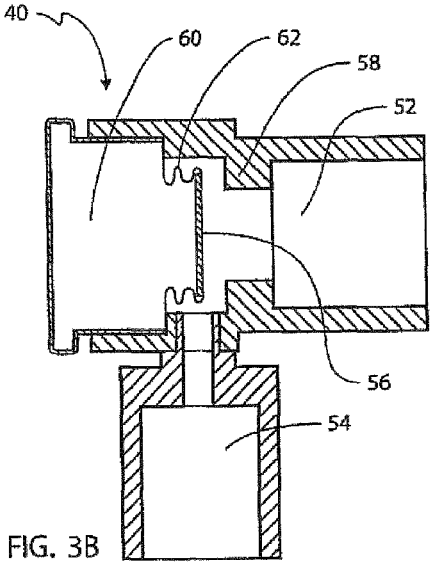

FIG. 3B shows an interruption valve 40 employing a sealed gas volume 60. The interruption valve 40 is in the open position. When the pressure in the inlet section 52, which is considered to correspond to the pressure in the collapsible beverage container, exceeds the pressure in the sealed gas volume 60, the valve plate 56 will move away from the valve seat 58 and allow beverage to pass from the inlet section 52 to the outlet section 54. When the pressure in the inlet section 52 again falls below the pressure in the sealed gas volume 60, the valve plate 56 will move towards the valve seat 58 and effectively prevent beverage from passing from the inlet section 52 to the outlet section 54.

Figure 4A:
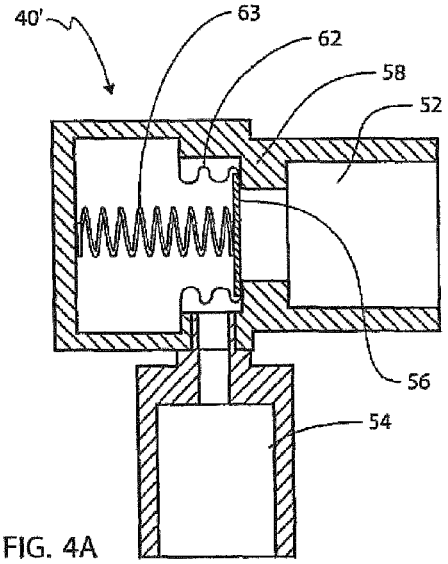
FIGS. 4A and 4B are cross-sectional views of an interruption valve employing a loaded spring, showing the valve in the closed and open positions, respectively.

FIG. 4A shows an interruption valve 40' employing a spring 63. The interruption valve 40' is in the closed position. The spring 63 has a predetermined spring constant and pre-load force and is mechanically connected to the valve plate 56 such that the valve plate 56 applies a specific non-zero pressure force against the valve seat 58.

Figure 4B:
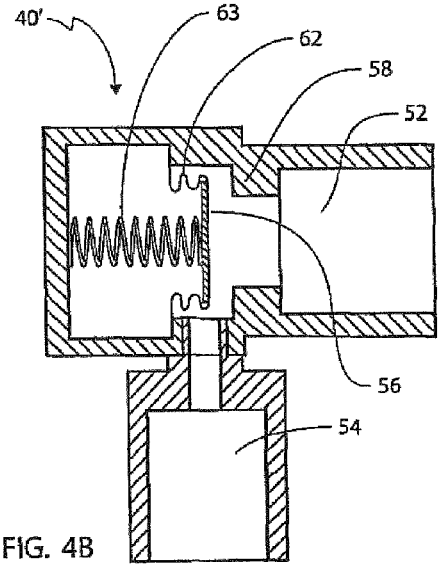

FIG. 4B shows an interruption valve 40' employing a spring 63. The interruption valve 40' is in the open position. When the pressure in the inlet section 52, which is considered to correspond to the pressure in the collapsible beverage container, exhibits a pressure force onto the valve plate 56 which exceeds the pre-load force of the spring 63, the valve plate 56 will move away from the valve seat 58 and allow beverage to pass from the inlet section 52 to the outlet section 54. When the pressure in the inlet section 52 again exhibits a pressure force onto the valve plate 56, which falls below the pre-load force of the spring 63, the valve plate 56 will move towards the valve seat 58 and effectively prevent beverage from passing from the inlet section 52 to the outlet section 54.

Figure 5A:
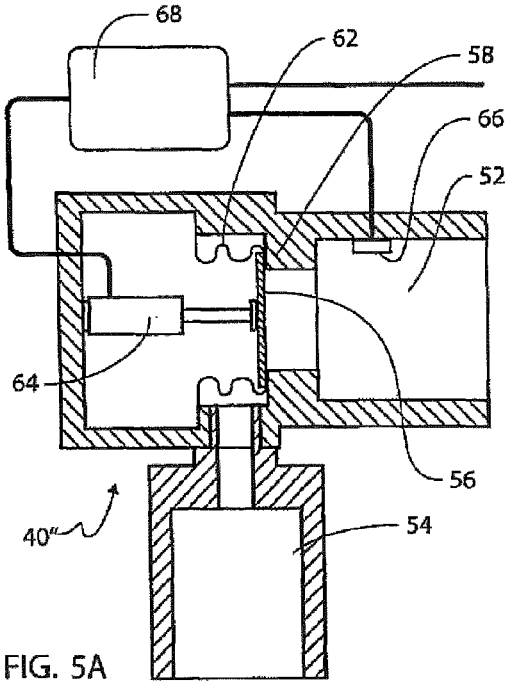
FIGS. 5A and 5B are cross-sectional views of an interruption valve employing a pressure probe and an electromagnetic valve, showing the valve in the closed and open positions, respectively.

FIG. 5A shows an interruption valve 40" employing an electromagnetic actuator 64. The interruption valve 40" is in the closed position. The electromagnetic actuator 64 is mechanically connected to the valve plate 56 and applies a sufficiently high pressure force against the valve seat 58 such that no beverage may pass. A pressure probe 66 is located in the inlet section 52 and measures the pressure of the beverage in the inlet section 56, which is considered to correspond to the pressure in the collapsible beverage container. The pressure is constantly evaluated by a control unit 68 and compared to the specific non-zero pressure reference.

Figure 5B:
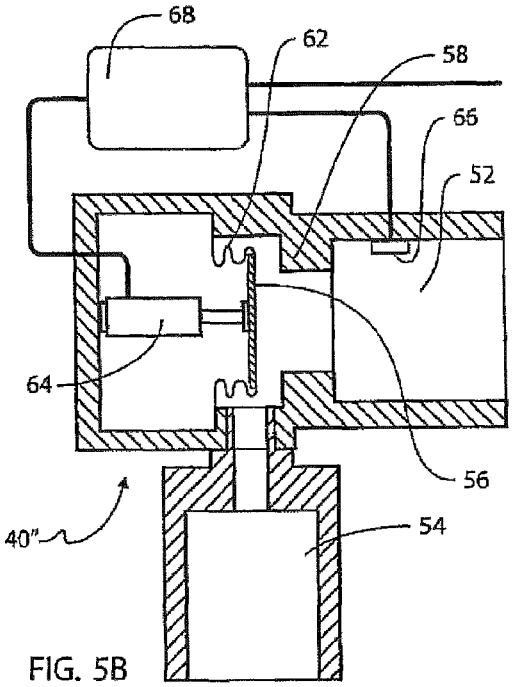

FIG. 5B shows an interruption valve 40" employing an electromagnetic actuator 64. The interruption valve 40" is in the open position. When the pressure measured by the pressure probe in the inlet section 52 exceeds the specific non-zero reference value, the control unit 68 will send a signal to the electromagnetic actuator for the valve plate 56 to move away from the valve seat 58 and allow beverage to pass from the inlet section 52 to the outlet section 54. When the pressure in the inlet section 52, measured by the pressure probe 66, again falls below the specific non-zero reference value, the electromagnetic actuator 64 will again make the valve plate 56 move towards the valve seat 58 and effectively prevent beverage from passing from the inlet section 52 to the outlet section 54. It is contemplated that the control unit may modify the specific non-zero reference value depending on the collapsible beverage container used and on the pressure in the pressure chamber.

FIG. 6A shows an interruption valve 40'" employing a gas volume 70 similar to the embodiment shown in connection with FIG. 3A. The interruption valve 40'" is in the closed position. The gas volume 70 communicates with the valve plate 56 via a sealed bellows 62, but distinguishes from the embodiment shown in connection with FIG. 3A in that the gas volume 70 is not sealed but connected via a pressure line 72 and a pressure reduction valve 74 to the pressure chamber, such that the valve plate 56 applies a specific non-zero pressure force, which is dependent on the pressure in the pressure chamber, against the valve seat 58.

FIG. 6B shows an interruption valve 40'" employing a gas volume 70. The interruption valve 40'" is in the open position. When the pressure in the inlet section 52, which is considered to correspond to the pressure in the collapsible beverage container, exceeds the pressure in the gas volume 70, the valve plate 56 will move away from the valve seat 58 and allow beverage to pass from the inlet section 52 to the outlet section 54. When the pressure in the inlet section 52 again falls below the pressure in the gas volume 70, the valve plate 56 will move towards the valve seat 58 and effectively prevent beverage from passing from the inlet section 52 to the outlet section 54. In this way the specific non-zero pressure reference may be modified depending on the pressure in the pressure chamber in order to establish an optimal closing occasion independent of the pressure in the pressure chamber.

FIG. 7 shows a collapsible beverage container 48' having an interruption valve 40"" and being mounted on a discharge valve 38 as described in FIGS. 2A-C. The collapsible beverage container 48' is located within a pressure chamber. The interruption valve 40"" is similar to the valve described in connection with FIGS. 2C and 3A. The interruption valve 40"", which forms part of the collapsible beverage container 48', comprise a valve plate 56'. When the interruption valve 40"" is in the closed position, the valve plate bears against a valve seat 58' in order to completely seal off the collapsible beverage container 48'. The sealed gas volume 60' has a predetermined pressure and communicates with the valve plate 56' via a sealed bellows 62' such that the valve plate 56' applies a specific non-zero pressure force against the valve seat 58. When the pressure in the collapsible beverage container 48' exceeds the pressure in the sealed gas volume 60', the valve plate 56' will move away from the valve seat 58' and allow beverage to pass. When the pressure in the collapsible beverage container 48' again falls below the pressure in the sealed gas volume 60', the valve plate 56' will move towards the valve seat 58' and effectively prevent beverage from passing.

Figure 8:
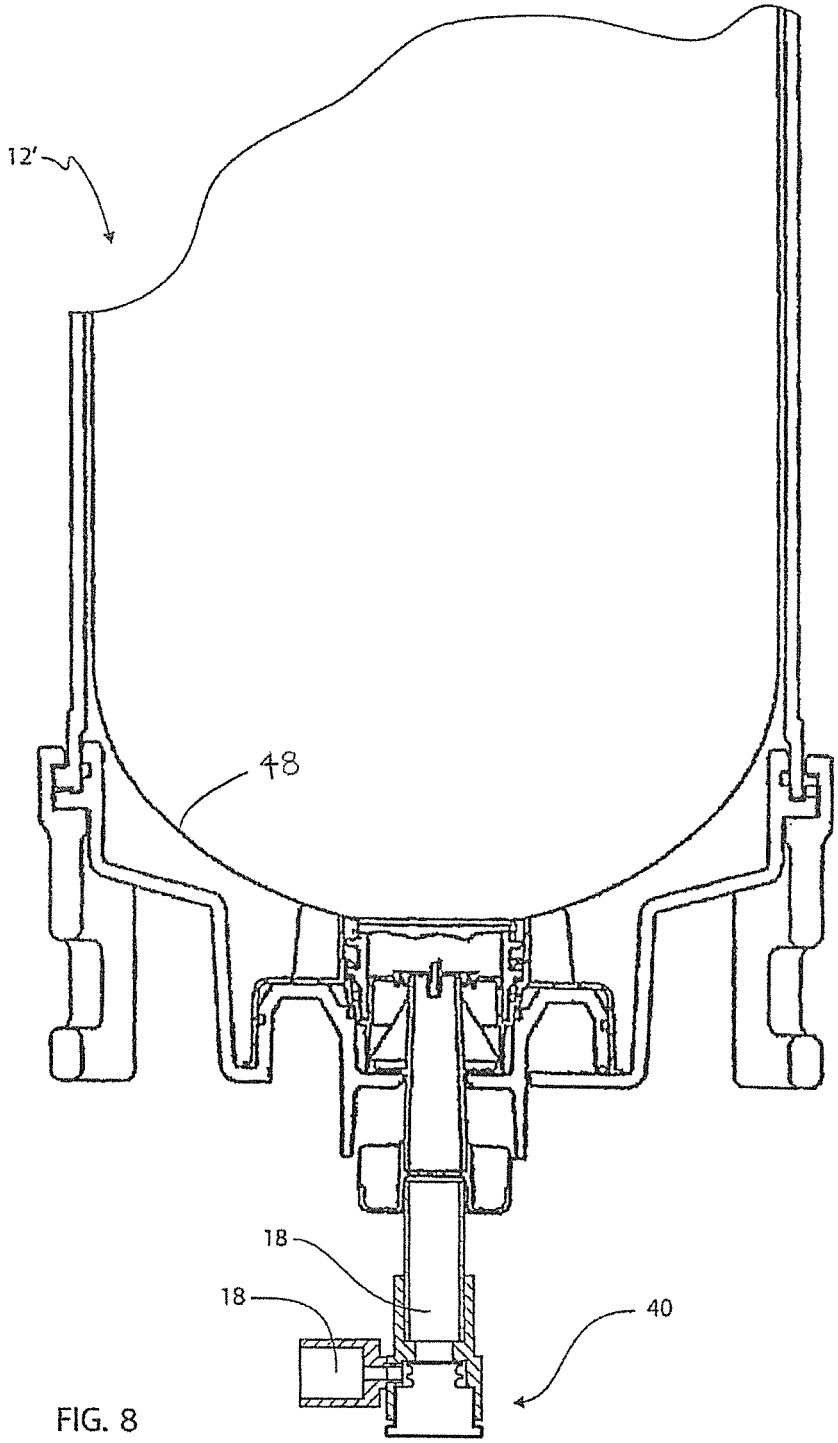
FIG. 8 is a cross-sectional view of an alternative beverage dispensing system having an interruption valve in the tapping line.

FIG. 8 shows an alternative beverage dispensing system 12' having an interruption valve 40 in the tapping line 18 similar to the embodiment shown in connection with FIGS. 2A and 2B. However, the discharge valve has been omitted such that a straight passage is achieved from the beverage container 48 through the tapping line 18, except for the provision of the interruption valve 40. It is understood that the interruption valve 40 may be located in the tapping line 18 as indicated in the figure or alternatively the interruption valve 40 may be located in the beverage container 48 as indicated in FIG. 7.

Figure 9A:
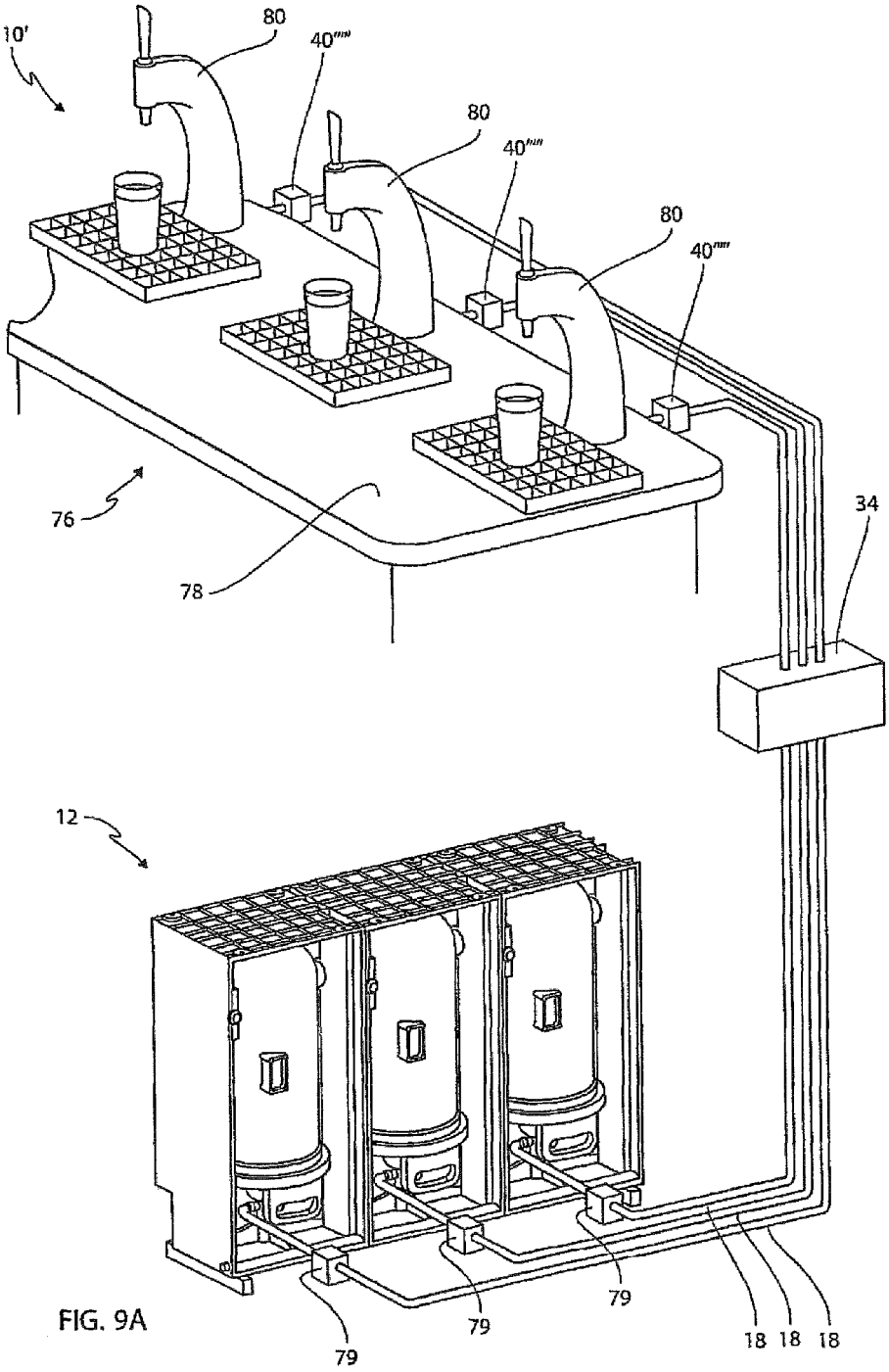
FIGS. 9A and 9B are perspective views of modular beverage dispensing systems having an interruption valve.

FIG. 9A shows a modular beverage dispensing system 10' including beverage dispensing modules 12 and a dispensing device 76. The dispensing device includes a bar counter 78 and a number of beverage taps 80, each including a tapping valve (not shown) and a tapping handle. The beverage dispensing operations are controlled by the tapping handle. The tapping lines 18 lead via a cooling system 34 to the taps 80. Each tapping line 18 is provided with an interruption valve (not shown), which may be included in the respective tap 80 or located adjacent the tap 80. The interruption valve may resemble any of the interruption valves shown in FIGS. 3A-6B. A non-return valve 79 may be installed in the tapping line 18 in order to avoid a return flow of beverage to the pressure chamber when exchanging beverage container.

Figure 9B:
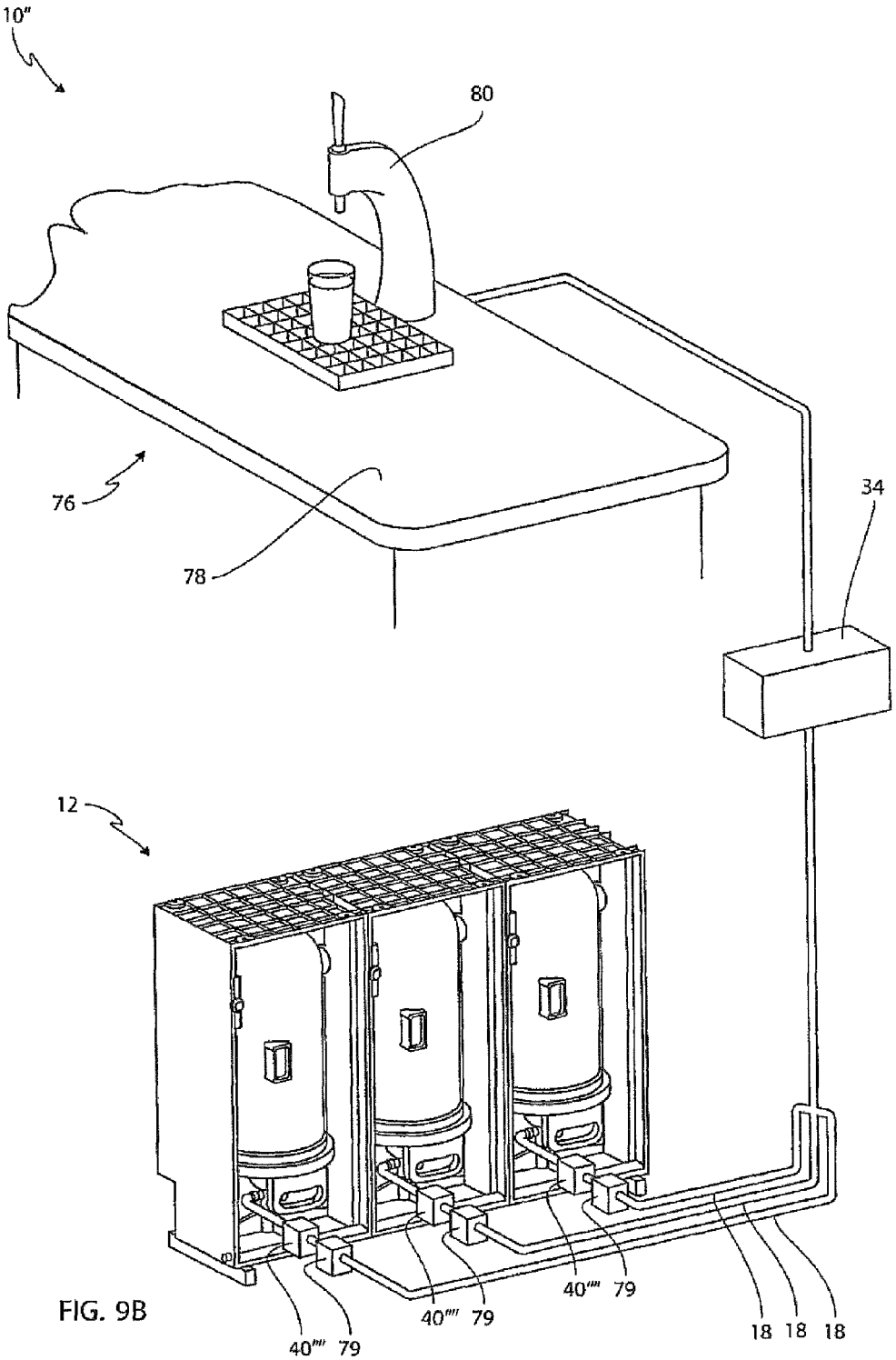

FIG. 9B shows a modular beverage dispensing system 10" which is similar to the beverage dispensing system of FIG. 9A except that the three tapping lines 18 originating from a respective beverage dispensing system 12 converge to a single tapping line which continues to a single tap 80. Each of the tapping lines 18 has an interruption valve 40"" and a non-return valve 79 located adjacent the beverage dispensing system.

Figure 10:
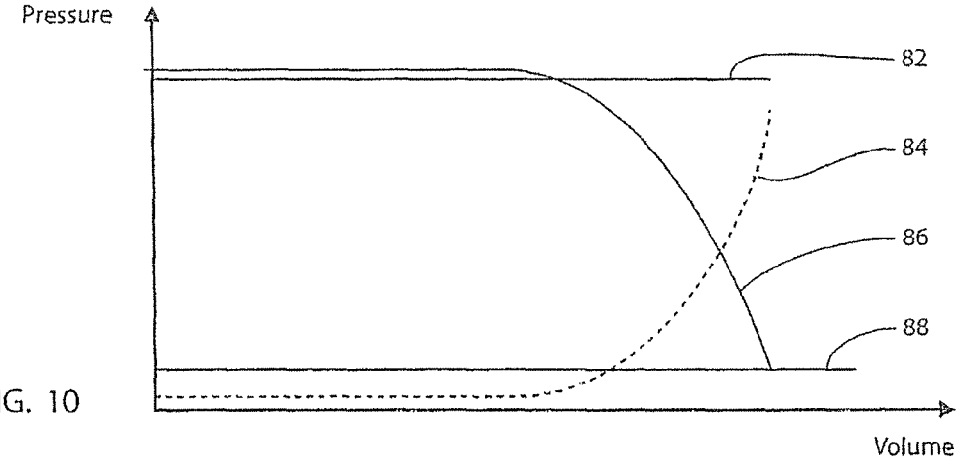
FIG. 10 is a plot showing the container crumpling pressure as a function of the volume of the dispensed beverage from the collapsible beverage container.

FIG. 10 shows a plot of pressure versus volume of the dispensed beverage from the collapsible beverage container. The curve 82 illustrates a constant first elevated pressure corresponding to the pressure in the pressure chamber. The curve 84 (dashed) illustrates the container crumpling pressure of the collapsible beverage container, i.e. the pressure required to crumple the beverage container, as a function of the volume of the dispensed beverage. When no or only very little beverage has been dispensed, the crumpling pressure is substantially constant. When a significant amount of beverage has been dispensed, the crumpling pressure increases exponentially. The curve 86 illustrates the second elevated pressure within the collapsible beverage container as a function of the volume of the dispensed beverage. As the crumpling pressure increases, the second elevated pressure decreases, as the sum of the crumpling pressure 84 and the second elevated pressure 86 is equal to the first elevated pressure 82. The curve 88 illustrates the specific non-zero pressure reference. When the second elevated pressure 86 falls below the specific non-zero pressure reference 88, the interruption valve closes and the beverage dispensing is interrupted.

Figure 11:
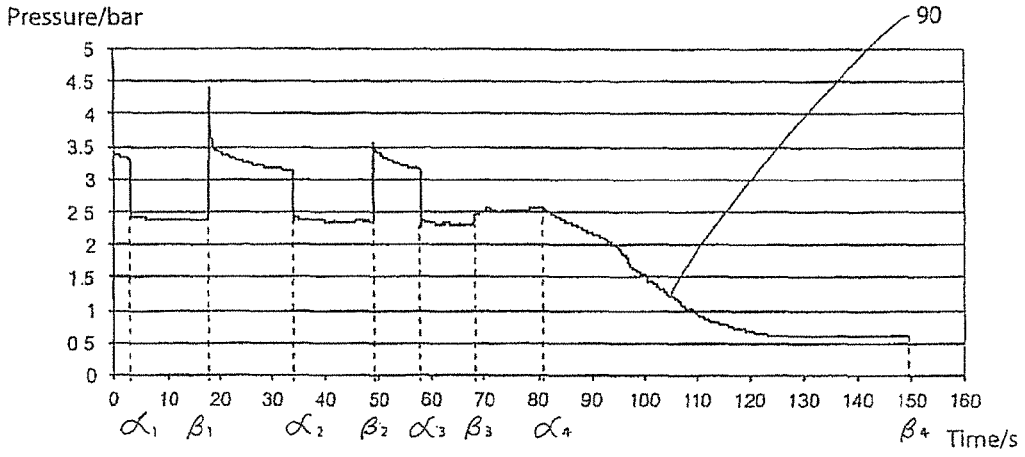
FIG. 11 is a plot showing the results of a proof of concept experiment conducted by the applicant.

FIG. 11 shows a plot of a proof-of concept experiment performed by the applicant. The curve 90 illustrates the pressure in the collapsible beverage container, i.e. the second elevated pressure, as a function of time during a number of dispensing operations using a constant pressure in the pressure chamber, i.e. the first elevated pressure, of 3.5 bar. The beverage dispensing operations are begun at time $\alpha_1$ when the dispensing device is switched from the non-beverage dispensing position to the beverage dispensing position. The beverage dispensing yields a relative pressure drop of about 1 bar. At time $\beta_1$ the dispensing device is switched back from the beverage dispensing position to the non-beverage dispensing position, thereby closing the tapping valve. This results in a shock wave and pressures up to 4.5 bar, however, the pressures quickly sink towards the initial pressure of about 3.5 bar. Further, similar beverage dispensing operations are performed at times $\alpha_2$, $\beta_2$, $\alpha_3$ and $\beta_3$. At time $\beta_3$, the crumpling pressure has increased such that the second elevated pressure no longer reaches the initial pressure of 3.5 bar, but just 2.5 bar. At time $\alpha_4$, the dispensing device is again switched from the beverage dispensing position to the non-beverage dispensing position resulting in a constant pressure drop from 2.5 bar to 0.5 bar, at which time the interruption valve closes and beverage dispensing is finally interrupted.

LIST OF PARTS WITH REFERENCE TO THE FIGURES

10. Modular beverage dispensing system
12. Beverage dispensing system (module)
14. Bottom wall
16. Rear wall
18. Tapping line
19. Mounting rack
20. Gas supply line -continued 22. Pressure generator
24. Pressure chamber
26. Pressure inlet
28. Pressure outlet
30. Tapping line inlet
32. Tapping line outlet
34. Cooling system
36. Pressure lid
38. Discharge valve
40. Interruption valve
42. Rod
44. Coupling mechanism
46. Closure element
48. Collapsible beverage container
50. Sealing gasket
47. Base part
52. Inlet section
54. Outlet section
56. Valve plate
58. Valve seat
60. Sealed gas volume
62. Bellows
63. Spring
64. Electromagnetic actuator
66. Pressure probe
68. Control unit
70. Gas volume
72. Pressure line
74. Pressure reduction valve
76. Dispensing device
78. Bar counter
79. Non-return valve
80. Beverage taps
82. First elevated pressure
84. Container crumple pressure
86. Second pressure
88. Specific non-zero pressure reference
90. Curve
49. Connector component

The invention claimed is:

1. A method of dispensing carbonated beverage, said method comprising the steps of:

(a) providing a beverage dispensing system, said beverage dispensing system comprising a pressure chamber, said pressure chamber accommodating a collapsible beverage container made of a flexible material, said collapsible beverage container including a beverage space containing carbonated beverage and a head space containing gas; a dispensing device including a tapping valve and defining a beverage dispensing position and a non-beverage dispensing position; a tapping line interconnecting said collapsible beverage container within said pressure chamber and said dispensing device; and an interruption valve defining an open position and a closed position, said open position allowing carbonated beverage to flow from said beverage space to said dispensing device when said pressure chamber is pressurized, said closed position preventing carbonated beverage from flowing from said beverage space to said dispensing device;

(b) maintaining a first elevated pressure within said pressure chamber, said first elevated pressure acting on said collapsible beverage container for crumpling said collapsible beverage container at a container crumpling pressure and establishing a second elevated pressure within said collapsible beverage container, said first elevated pressure being equal to said second elevated pressure added to said container crumpling pressure, said interruption valve assuming said open position when said second elevated pressure exceeds a specific non-zero pressure reference, said interruption valve assuming said closed position when said second elevated pressure falls below said specific non-zero pressure reference, wherein said interruption valve includes a pressure probe for determining said second elevated pressure and an electromagnetic actuator operable to switch said interruption valve between said open and closed positions, respectively, dependent on said second elevated pressure determined by said pressure probe: and (c) operating said dispensing device from said non-beverage dispensing position to said beverage dispensing position for causing said carbonated beverage to be dispensed at said dispensing device and said collapsible beverage container to crumple, if said interruption valve is assuming said open position.

2. The method according to claim 1, wherein said interruption valve is located in one of said collapsible beverage container, said tapping line, and said dispensing device.

3. The method according to claim 1, wherein said interruption valve employs a loaded spring in order to establish said specific non-zero pressure reference.

4. The method according to claim 1, wherein said interruption valve is fluidly connected to said first elevated pressure of said pressure chamber via a pressure regulator for establishing said specific non-zero pressure reference.

5. The method according to claim 1, wherein said first elevated pressure is in the range of 2-5 bar above atmospheric pressure.

6. The method according to claim 1, wherein said second elevated pressure is in the range of 1-4 bar above atmospheric pressure.

7. The method according to claim 1, wherein said beverage container is positioned in an upside down orientation within said pressure space such that the beverage space is located adjacent the tapping line and the head space is located spaced apart from the tapping line.

8. The method according to claim 1, wherein said specific non-zero pressure reference is in the range of 0.1-3 bar absolute pressure.

9. The method according to claim 1, wherein said crumpling pressure is dependent on the level of crumpling of said collapsible beverage container, said crumpling pressure being in the range of 0-1 bar absolute pressure when said beverage container is in an initial non-crumpled state, whereas said crumpling pressure is in the range of 2-5 bar when said beverage container is in a crumpled state in which the volume of said beverage container is reduced to 5% of the volume of said beverage container in said initial non-crumpled state.

10. The method according to claim 1, wherein, when said interruption valve is assuming said closed position, said beverage space has a volume of between 1 and 100 ml.

11. The method according to claim 1, wherein said flexible material comprises a thermoplastic material.

12. The method according to claim 1, wherein said interruption valve employs a sealed pressurized gas volume in order to establish said specific non-zero pressure reference.

13. A collapsible beverage container for use together with a beverage dispensing system, said beverage dispensing system comprising a pressure chamber for accommodating said collapsible beverage container, said pressure chamber being capable of maintaining a first elevated pressure within said pressure chamber, said collapsible beverage container being made of a flexible material and including a beverage space containing carbonated beverage and a head space containing gas, said first elevated pressure acting on said collapsible beverage container for crumpling said collapsible beverage container at a container crumpling pressure and establishing a second elevated pressure within said collapsible beverage container, said first elevated pressure being equal to said second elevated pressure added to said container crumpling pressure, said collapsible beverage container including an interruption valve defining an open position and a closed position, said open position allowing carbonated beverage to flow out from beverage space when said pressure chamber is pressurized, said closed position preventing carbonated beverage from flowing out from said beverage space, said interruption valve assuming said open position when said second elevated pressure exceeds a specific non-zero pressure reference, said interruption valve assuming said closed position when said second elevated pressure falls below said specific non-zero pressure reference, wherein said interruption valve includes a pressure probe configured for determining said second elevated pressure and an electromagnetic actuator operable to switch said interruption valve between said open and closed positions, respectively, dependent on said second elevated pressure.

14. A beverage dispensing system comprising:

a pressure chamber accommodating a collapsible beverage container made of a flexible material, said collapsible beverage container including a beverage space containing carbonated beverage and a head space containing gas, said pressure chamber being capable of maintaining a first elevated pressure within said pressure chamber, said first elevated pressure acting on said collapsible beverage container for crumpling said collapsible beverage container at a container crumpling pressure and establishing a second elevated pressure within said collapsible beverage container, said first elevated pressure being equal to said second elevated pressure added to said container crumpling pressure;

a dispensing device including a tapping valve and defining a beverage dispensing position and a non-beverage dispensing position; and a tapping line interconnecting said collapsible beverage container within said pressure chamber and said dispensing device, said tapping line including an interruption valve defining an open position and a closed position, said open position allowing carbonated beverage to flow from said beverage space to said dispensing device when said pressure chamber is pressurized, said closed position preventing carbonated beverage from flowing from said beverage space to said dispensing device, said interruption valve assuming said open position when said second elevated pressure exceeds a specific non-zero pressure reference, said interruption valve assuming said closed position when said second elevated pressure falls below said specific non-zero pressure reference, wherein said interruption valve includes a pressure probe configured for determining said second elevated pressure and an electromagnetic actuator operable to switch said interruption valve between said open and closed positions, respectively, dependent on said second elevated pressure.

15. A beverage dispensing system comprising:

a pressure chamber for accommodating a collapsible beverage container made of a flexible material, said collapsible beverage container including a beverage space containing carbonated beverage and a head space containing gas, said pressure chamber being capable of maintaining a first elevated pressure within said pressure chamber, said first elevated pressure acting on said collapsible beverage container for crumpling said collapsible beverage container at a container crumpling pressure and establishing a second elevated pressure within said collapsible beverage container, said first elevated pressure being equal to said second elevated pressure added to said container crumpling pressure;

a dispensing device including a tapping valve and defining a beverage dispensing position and a non-beverage dispensing position, said dispensing device including an interruption valve defining an open position and a closed position, said open position allowing carbonated beverage to flow from said beverage space to said dispensing device when said pressure chamber is pressurized, said closed position preventing carbonated beverage from flowing from said beverage space to said dispensing device, said interruption valve assuming said open position when said second elevated pressure exceeds a specific non-zero pressure reference, said interruption valve assuming said closed position when said second elevated pressure falls below said specific non-zero pressure reference, wherein said interruption valve includes a pressure probe configured for determining said second elevated pressure and an electromagnetic actuator operable to switch said interruption valve between said open and closed positions, respectively, dependent on said second elevated pressure; and a tapping line interconnecting said collapsible beverage container within said pressure chamber and said dispensing device.

* * * * *

UNITED STATES PATENT AND TRADEMARK OFFICE

CERTIFICATE OF CORRECTION

PATENT NO. : 9,266,708 B2
APPLICATION NO. : 14/376545
DATED : February 23, 2016
INVENTOR(S) : Jan Norager Rasmussen et al.

It is certified that error appears in the above-identified patent and that said Letters Patent is hereby corrected as shown below:

In the Specification

In column 8, line 10, after "position" insert -- . --.

In column 11, line 2, delete "12h" and insert -- 12b --, therefor.

In column 11, line 10, delete "4T" and insert -- 47' --, therefor.

Signed and Sealed this
Thirty-first Day of May, 2016

Michelle K. Lee

Michelle K. Lee
*Director of the United States Patent and Trademark Office*